US008215326B2

(12) United States Patent
Park et al.

(10) Patent No.: US 8,215,326 B2
(45) Date of Patent: Jul. 10, 2012

(54) ADJUSTABLE SUPPORT ASSEMBLY FOR A COLLAPSIBLE CANOPY

(75) Inventors: Bumjun Park, Suzhou (CN); Martin James Dotterweich, Escondido, CA (US); Rusty George Summar, Brenham, TX (US)

(73) Assignee: HKD International (HK) Limited, North Point (HK)

( * ) Notice: Subject to any disclaimer, the term of this patent is extended or adjusted under 35 U.S.C. 154(b) by 47 days.

(21) Appl. No.: 12/373,247

(22) PCT Filed: Jul. 10, 2007

(86) PCT No.: PCT/US2007/073170

§ 371 (c)(1), (2), (4) Date: Jan. 9, 2009

(87) PCT Pub. No.: WO2008/008787

PCT Pub. Date: Jan. 17, 2008

(65) Prior Publication Data

US 2009/0314323 A1 Dec. 24, 2009

Related U.S. Application Data

(60) Provisional application No. 60/819,713, filed on Jul. 10, 2006.

(51) Int. Cl.
*E04H 15/50* (2006.01)

(52) U.S. Cl. ..... 135/145; 135/121

(58) Field of Classification Search ..... 135/120.1, 135/120.3, 131, 135, 143, 144, 145, 158, 135/159, 160

See application file for complete search history.

(56) References Cited

U.S. PATENT DOCUMENTS

| | | | | |
|---|---|---|---|---|
| 1,853,367 | A * | 4/1932 | Mace | 135/123 |
| 2,230,454 | A | 2/1941 | Friesner et al. | |
| 2,530,765 | A * | 11/1950 | Greenup | 135/98 |
| 2,704,963 | A | 3/1955 | Parachek | |
| 2,723,673 | A * | 11/1955 | Call | 135/140 |
| 3,495,857 | A * | 2/1970 | Hawke et al. | 403/57 |
| 4,066,089 | A * | 1/1978 | Rainwater | 135/151 |
| 4,165,757 | A | 8/1979 | Marks | |
| 4,265,261 | A | 5/1981 | Barker | |
| 4,607,656 | A | 8/1986 | Carter | |
| 4,779,635 | A | 10/1988 | Lynch | |
| 4,838,293 | A | 6/1989 | Novak | |
| 4,876,829 | A | 10/1989 | Mattick | |

(Continued)

OTHER PUBLICATIONS

Korean Intellectual Property Office: Technical Evaluation Decision "Automatic Tent with Snap Through" Application Date: Feb. 9, 2004.

(Continued)

*Primary Examiner* — Noah Chandler Hawk

(74) *Attorney, Agent, or Firm* — Polster Lieder Woodruff & Lucchesi, L.C.

(57) ABSTRACT

A collapsible shelter assembly includes plurality of legs with each of the legs having an upper, a lower end and an axis. A truss system links each pair of legs together and defines a perimeter. Rods are adapted for supporting a cover and brackets are adapted for attaching the rods to the legs. Each of the brackets has a base adapted for attachment to the upper end one of the legs and a coupler mounted to the base for attaching one of the rods. Each bracket is configured so that at least one of the base and the coupler is rotatable relative to the leg axis.

41 Claims, 9 Drawing Sheets

U.S. PATENT DOCUMENTS

| | | | | | |
|---|---|---|---|---|---|
| 4,898,085 | A | | 2/1990 | Jarnot | |
| 4,979,531 | A | | 12/1990 | Toor et al. | |
| 5,005,322 | A | | 4/1991 | Mattick et al. | |
| 5,467,794 | A | | 11/1995 | Zheng | |
| 5,485,863 | A | | 1/1996 | Carter | |
| 5,490,533 | A | | 2/1996 | Carter | |
| 5,511,572 | A | | 4/1996 | Carter | |
| 5,632,292 | A | | 5/1997 | Carter | |
| 5,632,293 | A | | 5/1997 | Carter | |
| 5,638,853 | A | * | 6/1997 | Tsai | 135/145 |
| 5,655,340 | A | | 8/1997 | Pelsue | |
| 5,700,102 | A | * | 12/1997 | Feleppa | 403/170 |
| 5,797,412 | A | | 8/1998 | Carter | |
| 5,813,425 | A | | 9/1998 | Carter | |
| 5,921,260 | A | | 7/1999 | Carter | |
| 5,934,301 | A | | 8/1999 | Carter | |
| 6,035,887 | A | | 3/2000 | Cato | |
| 6,041,800 | A | | 3/2000 | Carter | |
| 6,070,604 | A | | 6/2000 | Carter | |
| 6,076,312 | A | | 6/2000 | Carter | |
| 6,089,247 | A | | 7/2000 | Price | |
| 6,129,102 | A | | 10/2000 | Carter | |
| 6,138,702 | A | | 10/2000 | Carter | |
| 6,192,910 | B1 | | 2/2001 | Carter | |
| 6,230,729 | B1 | | 5/2001 | Carter | |
| 6,240,940 | B1 | | 6/2001 | Carter | |
| 6,363,956 | B2 | | 4/2002 | Carter | |
| 6,382,224 | B1 | | 5/2002 | Carter | |
| 6,397,872 | B1 | | 6/2002 | Carter | |
| 6,412,507 | B1 | | 7/2002 | Carter | |
| 6,431,193 | B2 | | 8/2002 | Carter | |
| 6,439,251 | B2 | | 8/2002 | Carter | |
| 6,470,902 | B1 | | 10/2002 | Carter | |
| 6,502,597 | B2 | | 1/2003 | Carter | |
| 6,520,196 | B2 | | 2/2003 | Carter | |
| 6,601,599 | B2 | | 8/2003 | Carter | |
| D485,928 | S | | 1/2004 | Leung et al. | |
| 6,679,643 | B1 | | 1/2004 | Ham | |
| 6,701,949 | B2 | | 3/2004 | Carter | |
| 6,708,707 | B2 | | 3/2004 | Dotterweich et al. | |
| 6,712,083 | B2 | | 3/2004 | Carter | |
| 6,718,995 | B2 | | 4/2004 | Dotterweich | |
| 6,748,963 | B2 | | 6/2004 | Carter | |
| 6,763,841 | B1 | | 7/2004 | Cantwell | |
| 6,796,320 | B2 | | 9/2004 | Carter | |
| 6,848,461 | B2 | * | 2/2005 | Tsai | 135/131 |
| 6,868,858 | B2 | | 3/2005 | Suh | |
| 6,874,520 | B2 | | 4/2005 | Carter | |
| 6,920,889 | B2 | | 7/2005 | Carter | |
| 6,926,021 | B2 | | 8/2005 | Carter | |
| 6,981,510 | B2 | | 1/2006 | Carter | |
| 7,051,745 | B2 | | 5/2006 | Carter | |
| 7,178,541 | B2 | | 2/2007 | Carter | |
| 7,178,542 | B2 | | 2/2007 | Carter | |
| 7,182,092 | B1 | | 2/2007 | Cantwell | |
| 7,363,933 | B2 | * | 4/2008 | Carter | 135/145 |
| 7,703,469 | B2 | * | 4/2010 | Danziger | 135/147 |
| 2004/0020369 | A1 | | 2/2004 | Long et al. | |
| 2004/0020484 | A1 | | 2/2004 | Skidmore et al. | |
| 2005/0120640 | A1 | | 6/2005 | Cantwell | |
| 2006/0032524 | A1 | | 2/2006 | Carter | |
| 2006/0118155 | A1 | | 6/2006 | Carter | |
| 2006/0174929 | A1 | | 8/2006 | Tseng | |
| 2007/0028954 | A1 | | 2/2007 | Carter | |
| 2007/0051397 | A1 | * | 3/2007 | Choi | 135/131 |
| 2007/0221262 | A1 | * | 9/2007 | Tsai et al. | 135/145 |
| 2010/0043856 | A1 | * | 2/2010 | Park et al. | 135/145 |
| 2011/0073148 | A1 | * | 3/2011 | Choi | 135/145 |

OTHER PUBLICATIONS

Korean Intellectual Property Office (KR), Laid Open Patent Publication, "Automatic Tent with Snap-Thru", May 17, 2005.

* cited by examiner

ADJUSTABLE SUPPORT ASSEMBLY FOR A COLLAPSIBLE CANOPY

CROSS-REFERENCE TO RELATED APPLICATIONS

This application is a United States national phase under 35 USC §371 of PCT/US2007/073170, filed Jul. 10, 2007, which claims the benefit of U.S. Provisional Application No. 60/819,713, filed on Jul. 10, 2006 which is incorporated herein be reference. This application is also related co-pending application of PCT/US2007/072859 filed Jul. 5, 2007 and co-pending application of PCT/US2007/073176 filed Jul. 10, 2007.

FIELD

The present disclosure relates to collapsible structures and, more specifically, to an adjustable support assembly for mounting a canopy support rod.

BACKGROUND

The statements in this section merely provide background information related to the present disclosure and may not constitute prior art.

There are a number of temporary shelters that can be transported and rapidly set up for a variety of uses. In general, these structures include an underlining or supporting frame, which includes at least three, and often four-corner posts or legs. Commonly, the legs are in two parts arranged to telescope within one another so as to define a lower retracted position and an extended position for use. A supporting beam or brace structure is attached to each of the legs at an upper fixed position and at the lower position at a slider moveably mounted on the leg. The slider moves with and on the leg to an extended position for use. The beam structure conventionally is a "scissors" arrangement, which enables the legs and beam structure to be compressed into a low profile configuration for transporting or storage. A supporting frame is coupled to the legs to support a canopy.

Typically, these existing canopy support assemblies work well for their intended purpose, their structures are relatively expensive to manufacture and do not lend themselves easily to the adoption of a variety of canopy top configurations. Additionally, the coverage area of canopy is limited to the footprint defined by the legs.

SUMMARY

The inventors hereof have succeeded at designing canopy support assemblies that is an improvement over existing designs.

According to one aspect, a collapsible shelter assembly includes a plurality of legs with each of the legs having an upper, a lower end and an axis. A truss system links each pair of legs together and defines a perimeter. Rods are adapted for supporting a cover and brackets are adapted for attaching the rods to the legs. Each of the brackets has a base adapted for attachment to the upper end one of the legs and a coupler mounted to the base for attaching one of the rods. Each bracket is configured so that at least one of the base and the coupler is rotatable relative to the leg axis.

According to another aspect, a collapsible shelter assembly has a plurality of legs, each of the legs having an upper end and a lower end, a truss system linking each pair of legs together and forming a perimeter, and a cover. The assembly comprises plurality of rods are configured to support the cover and means for pivotally coupling each rod to an upper end of one of the legs.

According to yet another aspect, a collapsible shelter assembly having a plurality of legs, each of the legs having an upper end and a lower end, and a truss system linking each pair of legs together and forming a perimeter includes a plurality of rods and a plurality of brackets. Each bracket has a base adapted for attaching to the upper end one of the legs and a coupler pivotally mounted to the base and adapted for attaching to one of the rods. A cover is configured to be supported by the rods to form a canopy when the rods are attached to the bracket couplers and the bracket bases are attached to the upper ends of the legs.

Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

It should be understood that throughout the drawings, corresponding reference numerals indicate like or corresponding parts and features.

DETAILED DESCRIPTION

The following description is merely exemplary in nature and is not intended to limit the present disclosure or the disclosure's applications or uses.

Figure 1:
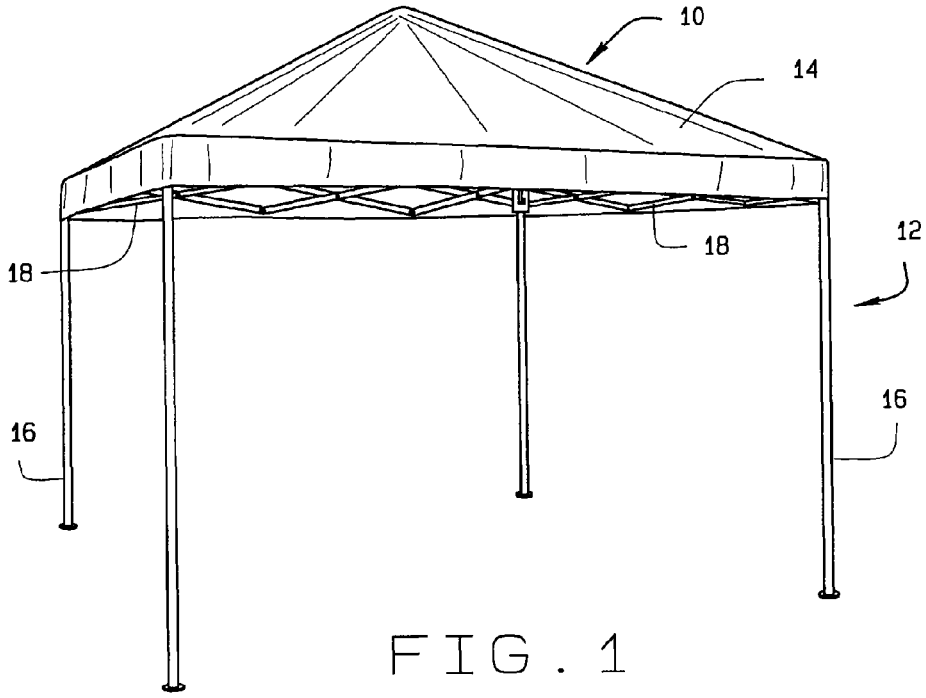
FIG. 1 is a side perspective view of an erected collapsible canopy shelter having an adjustable support assembly according to one exemplary embodiment.
Figure 2:
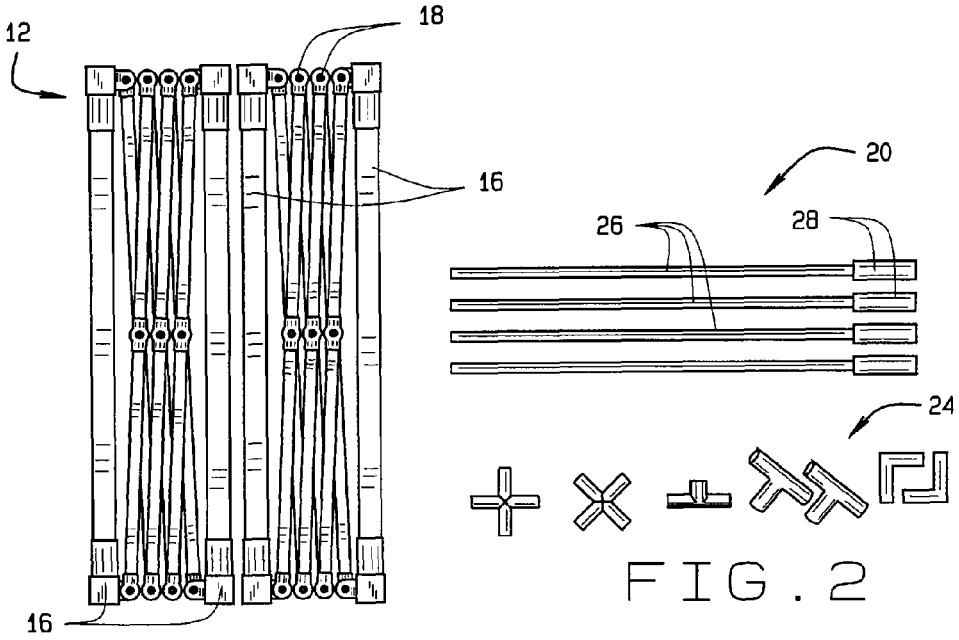
FIG. 2 is a side view of a collapsed canopy shelter having an adjustable support assembly according an exemplary embodiment.
Figure 3:
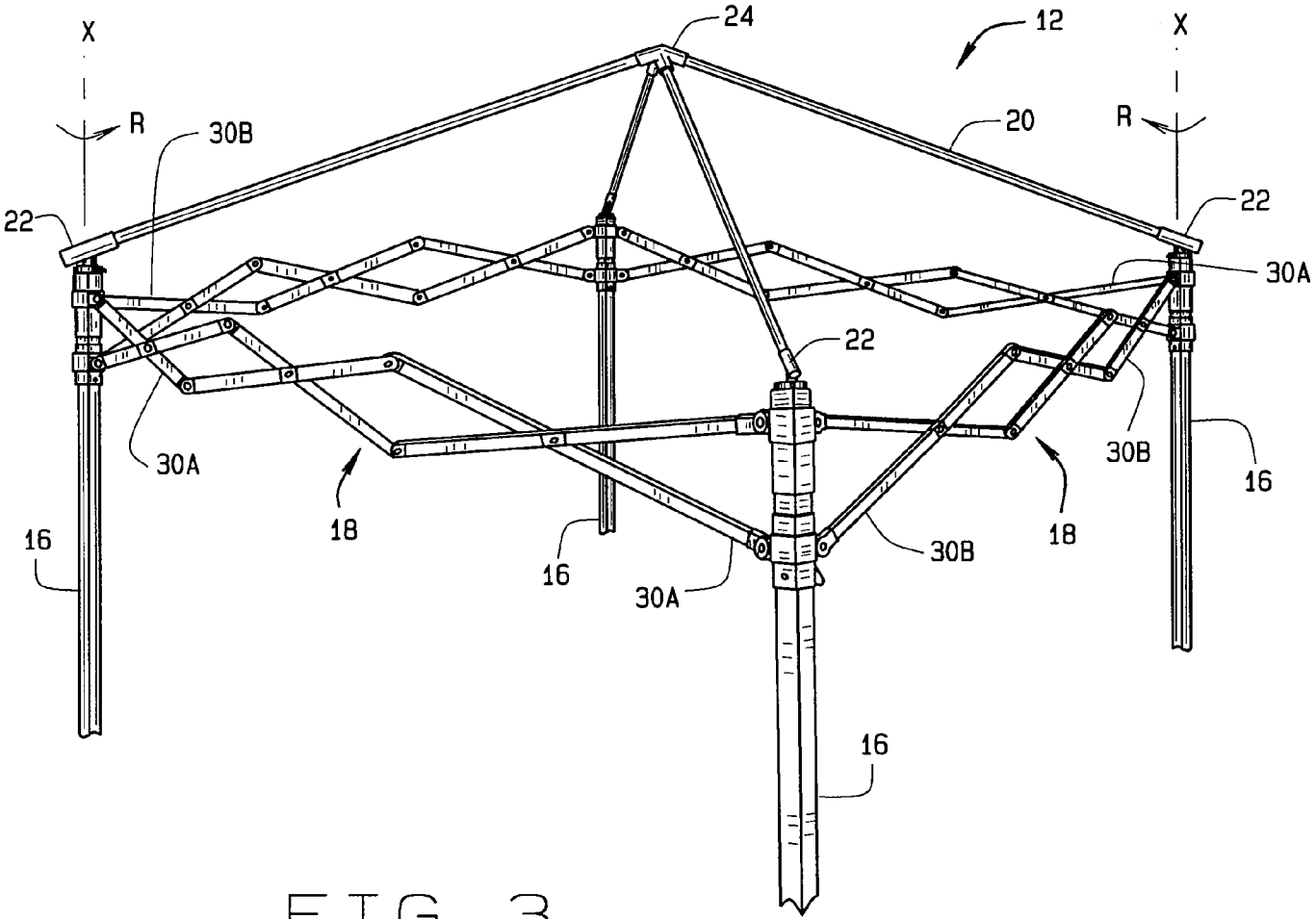
FIG. 3 is a top perspective view of an erected canopy support structure with adjustable support assemblies according to one exemplary embodiment.
Figure 4A:
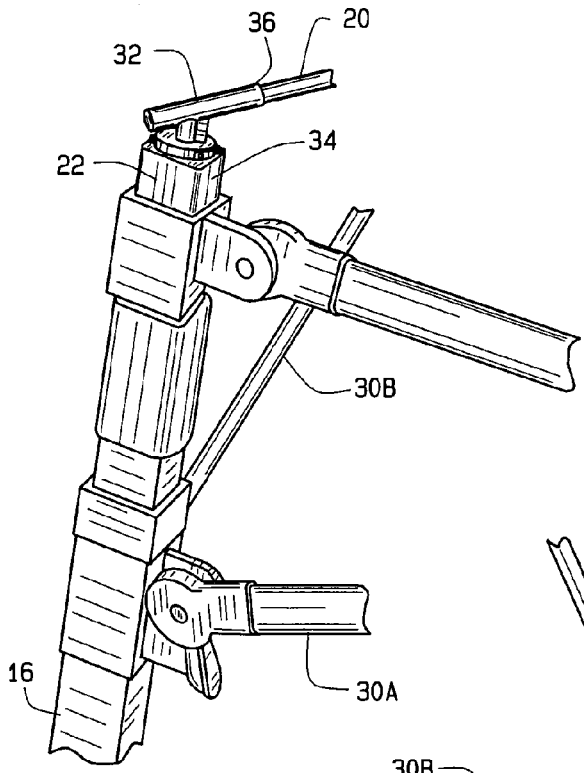
FIGS. 4A and 4B are perspective views of top a leg assembly and adjustable canopy support assembly according to another exemplary embodiment.
Figure 4B:
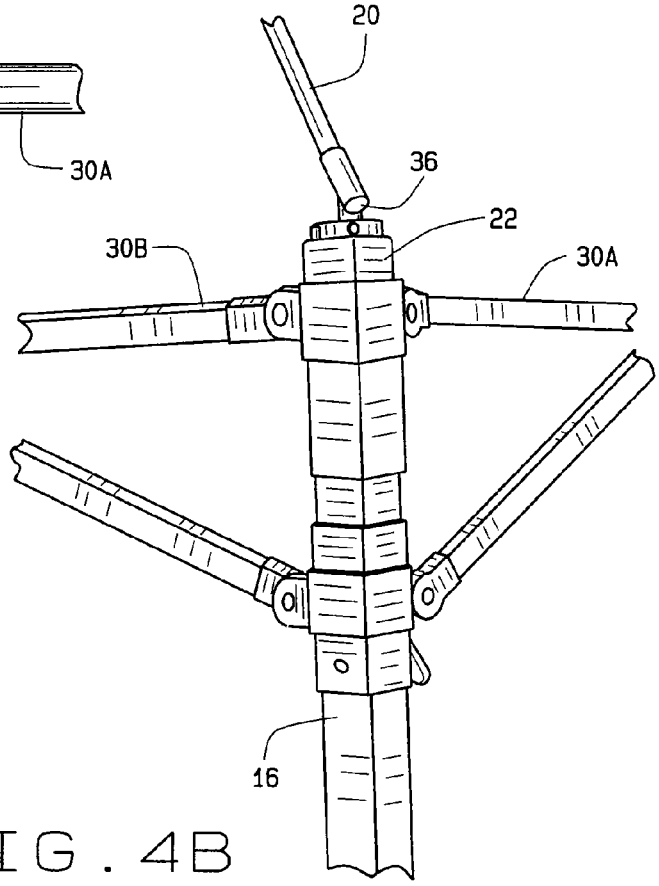

In some embodiments, such as the exemplary embodiments of FIGS. 1, 2, and 3 include a collapsible shelter 10 having a support assembly 12 and a cover 14. The support assembly 12 has legs 16 and a truss system 18. While four legs 16 are depicted in FIG. 1, three or more legs 16 are possible and still considered within the scope of this disclosure. Each leg 16 has an upper end, a lower end, and an axis X as illustrated in FIG. 3. Each leg 16 can be solid or hollow and of any shape. In some embodiments, each leg 16 is hollow and defines a cavity at its upper end.

Supporting rods 20 for the cover 14 are coupled to the legs 16 for forming a canopy or roof to the collapsible shelter 10. Brackets 22 attach the rods 20 to the upper end of the legs 16.

The rods 20 extend between the tops of two legs 16 for supporting a cover 14 to form a roof of the shelter 10. These can form any shape of shelter 10 including a pyramid, a dome, a hut, and an arch, by way of examples. A proximate end of the rod 20 can attach or couple to a bracket 22 and a distal end can be coupled or attached to a second bracket 22 or can be attached to a hub 24 as shown in FIGS. 2 and 3. The bracket 22 and the hub 24 can be fixed or releasably coupled to the rod 20.

The hub 24 can have any shape for attaching distal ends of two or more rods 20, some of which are shown in FIG. 2 by way of example. The rods 20 can be a single body of rigid or flexible design, or can be assembled from two or more rod segments 26 with connectors 28 as shown in FIG. 2. In this manner, the rods 20 can be compactly stored when the shelter 10 is collapsed, but provide from a proper elongated length for erection of the shelter 10.

As shown in the exemplary embodiments of FIGS. 4A, 4B, 5A, 5B, 6A, 6B, 7, 9, 10, and 11, each bracket 22 has a coupler 32 that attaches to a rod 20 and a base 34 that attaches to the upper end of one of the legs 16. The coupler 32 can include a receptacle 36, such as a bore, for receiving an end of the rod 20 or can include another means for attaching to the rod 20, such as a clamp or saddle, not shown. The receptacle 36 can be configured to only receive the end of the rod 20 or can be configured to allow a predefined length of the end of the rod 20 pass through and beyond the bracket 22. In such an embodiment, the extended rod 20 can provide a coverage area for the cover 14 that has an area greater than the footprint defined by the legs 16.

Figure 8A:
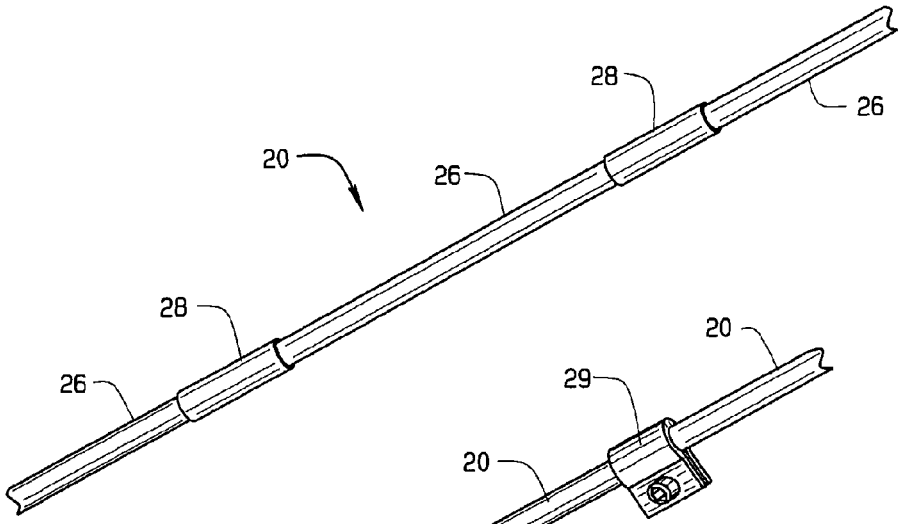
FIG. 8A is a side perspective view of a multi-segment canopy support rod adaptable for use with the adjustable support assembly according to one exemplary embodiment.
Figure 8B:
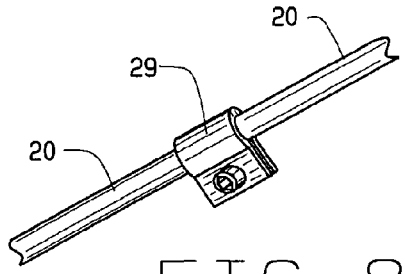
FIG. 8B is a side perspective view of a stop for use with an adjustable support assembly according to another embodiment.

Additionally, the coupler 32 can be configured to engage one or more stops, such as a connector 28 or clamp 29, as illustrated in FIGS. 8A and 8B for securing the rod 20 within the receptacle 36. The base 34 couples to the upper end of the leg 16 such as by insertion into a cavity of the leg 16, or having a cavity for receiving the upper end of the leg 16, by way of examples.

The bracket 22 is configured for rotation of the attached rod 20 relative to the leg axis X. This can be provided by the rotation of the coupler 32 relative to the base 34 or rotation of the base 34 relative to the attached leg 16, some of which are shown in the exemplary figures.

Figure 5A:
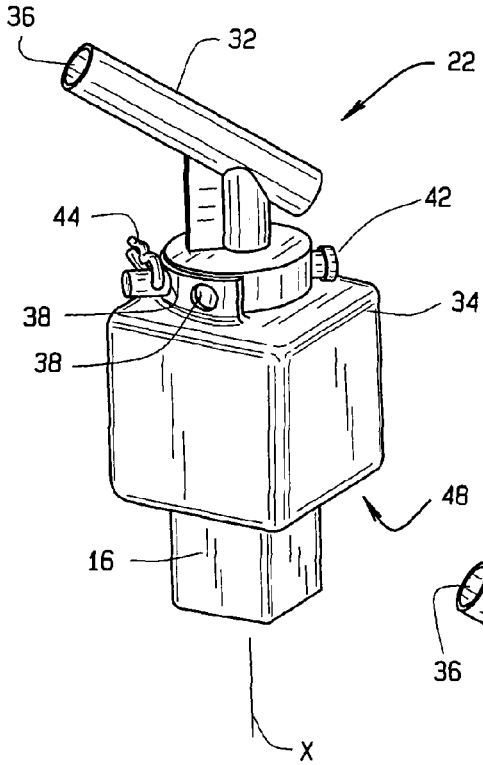
FIGS. 5A and 5B are side perspective views of an adjustable support assembly with a pivotal coupler and a locking assembly according to one exemplary embodiment.
Figure 5B:
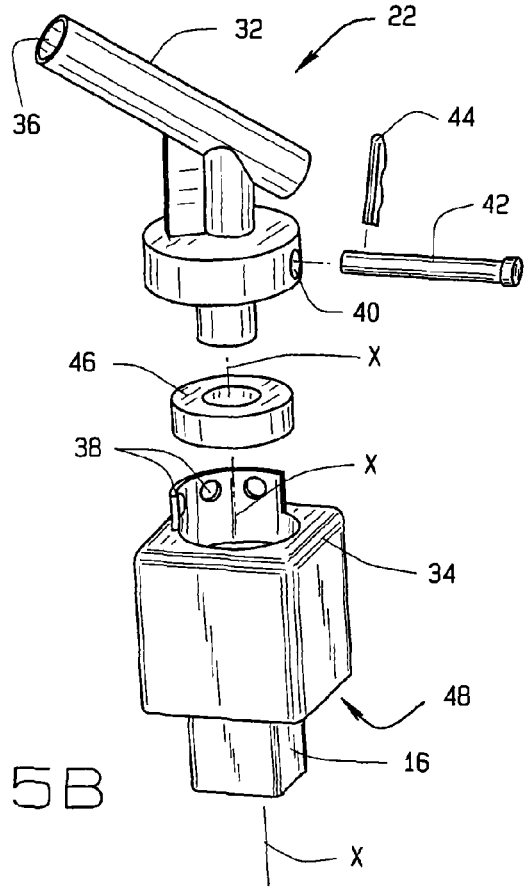

In one embodiment, as illustrated in FIGS. 5A and 5B, the base 34 can be fixed relative to the leg axis X. The coupler 32 is rotatable relative to the base 34 about the axis X. In this example, the bracket 22 has a locking mechanism 37 that is configured to lock the rotatable coupler 32 in a fixed position relative to the base 34. As shown, the base 34 includes a plurality of locking holes 38 positioned radially about a portion of the base 34. The coupler 32 has at least one hole 40 for receiving a pin 42 that goes through the hole 40 and into one of the holes 38 of the base 34 for preventing the further rotation of the coupler 32. A locking pin 44 can be engaged with the pin 42 to secure the pin 42 if desired. The bracket 22 can also include a bearing 46 to aid in the rotation of the coupler 32 about the axis X. In this embodiment, the base 34 includes a cavity 48 for receiving the upper end of the leg 16.

Figure 6A:
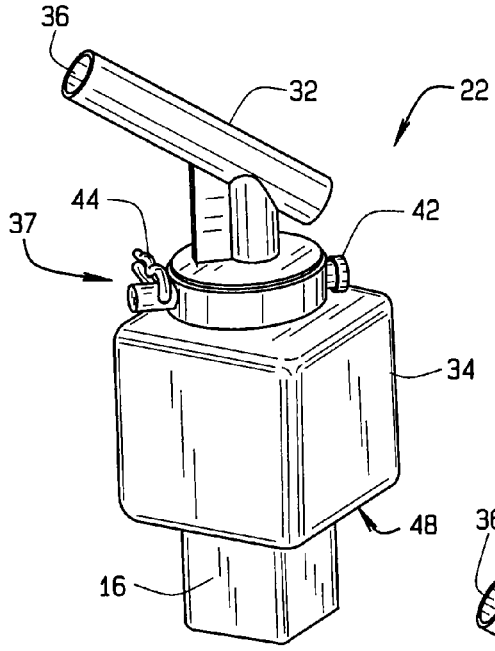
FIGS. 6A and 6B are side perspective views of an adjustable support assembly with a pivotal coupler and a locking assembly according to another exemplary embodiment.
Figure 6B:
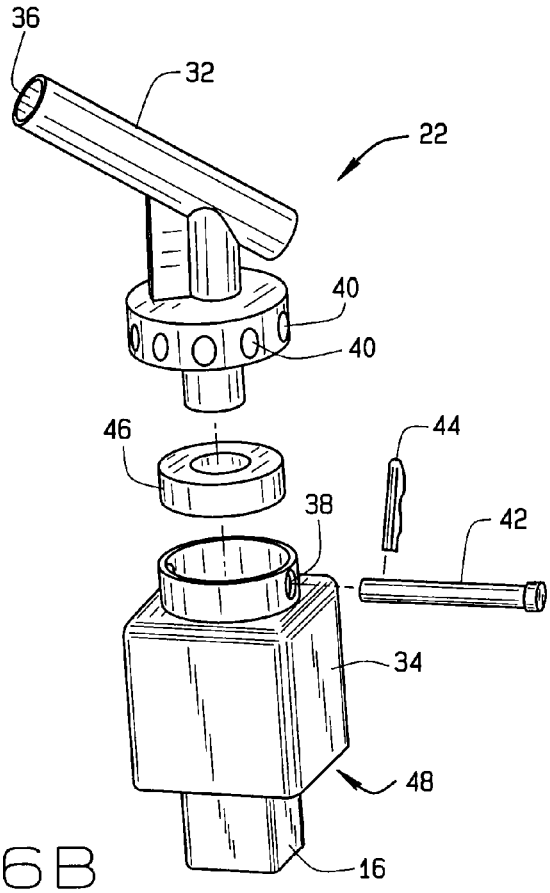

FIGS. 6A and 6B illustrate another embodiment where the locking mechanism 37 includes a plurality of holes 40 positioned radially about the coupler 32 and one or more holes in the base 34. The pin 42 configured for insertion into one of the holes 38 of the base 34 and one of the holes 40 of the coupler 32.

Figure 7:
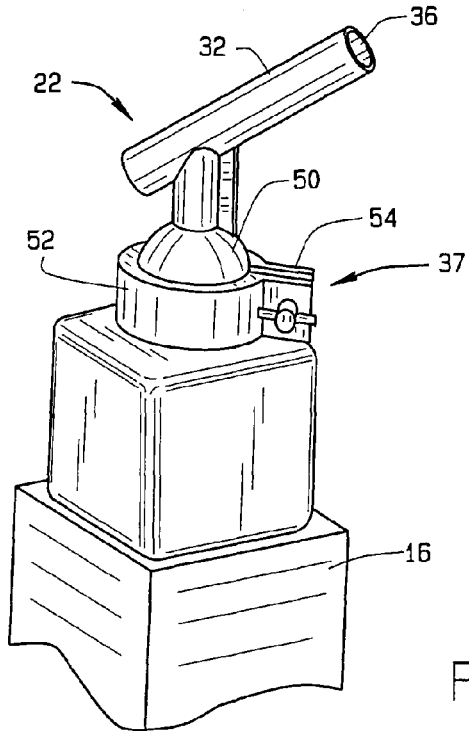
FIG. 7 is a side perspective view of an adjustable support assembly having a locking ball and socket according to yet another exemplary embodiment.
Figure 9:
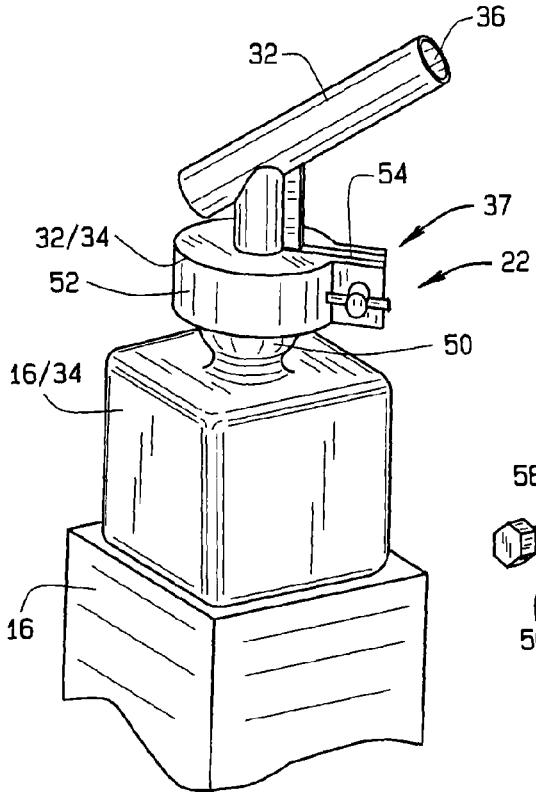
FIG. 9 is a side perspective view of an adjustable support assembly having a locking ball and socket according to another exemplary embodiment.

FIGS. 7 and 9 illustrate additional embodiments wherein the bracket 22 includes a ball 50 and socket 52 for providing the rotational coupling of the rod 20 to the leg 16. In these examples, the locking mechanism 37 includes a clamp 54 configured with the socket 52 for locking the position of the ball within the socket. In these embodiments, the coupler 32 is not only rotatable about the axis X defined by the leg 16, but can also be rotated vertically in a plane including the axis X. It should also be noted that, in an alternative embodiment as represented by FIG. 9, the ball 50 could be a feature of the top end of the leg 16 and the socket 52 could be a feature of the base 34. This could also include the alternative where the socket 52 is a feature of the leg 16 and the ball 50 is defined by the base 34.

Figure 10:
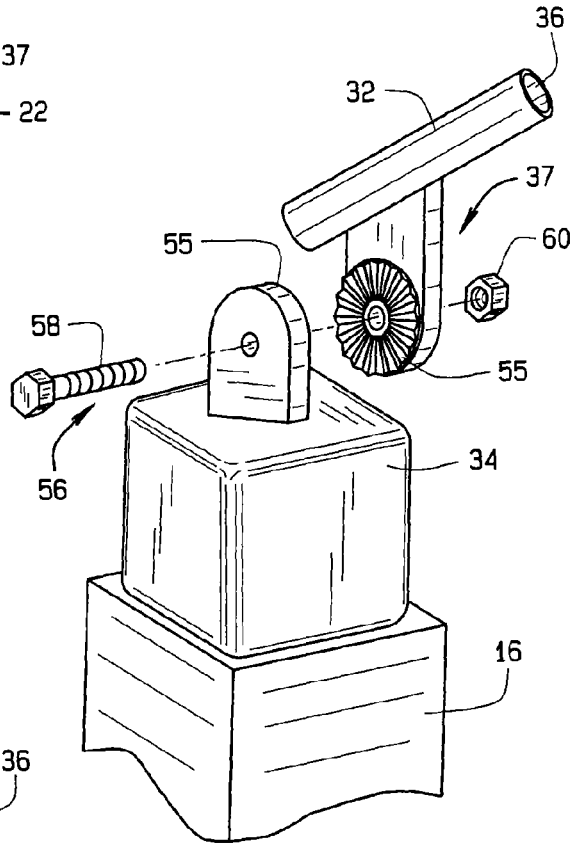
FIG. 10 is a side perspective view of an adjustable support assembly having a knurled locking feature according to another exemplary embodiment.

Referring now to FIG. 10, another exemplary embodiment provides for only the rotation of the coupler 32 in a plane including the axis X. In this example, the coupler 32 attaches to the base 34 via a locking mechanism 37 that includes one or more and preferably a pair of mated knurled portions 55 and a fastener 56, which is illustrated as a bolt 58 and nut 60. Of course in other embodiments, the rotatable arrangement and locking mechanism 37 can be combined with an assembly having a rotation only about the axis X, such as shown in FIGS. 6 and 7, for example.

Figure 11:
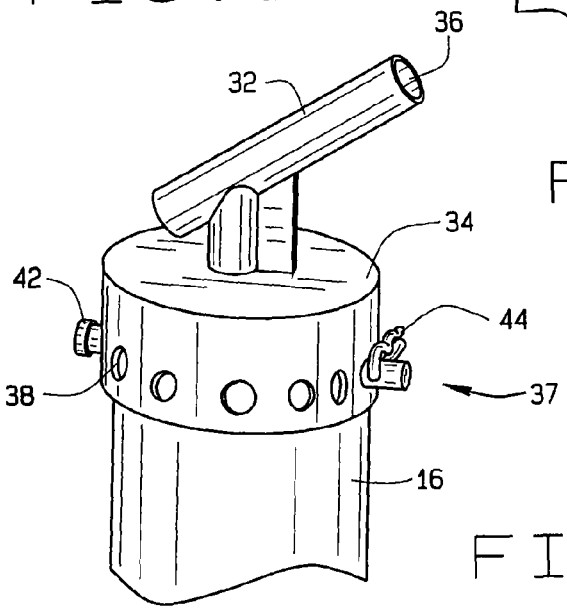
FIG. 11 is a side perspective view of an adjustable support assembly having rotational locking adjustment for locking with a top of a round leg assembly according to another exemplary embodiment.

FIG. 11 illustrates an exemplary embodiment where the top end of the leg 16 is round. In this embodiment, a plurality of holes 38 can be formed in the leg 16 or in the base 34, as shown, and the pin 42 inserted through the holes 38 for securing the angular position of the base 34 relative to the axis X defined by the leg 16.

The truss system 18 attaches to or links each pair of adjacent legs 16 together and defines a perimeter of the support assembly 12. The truss system 18 can be of any design and construction. In some embodiments, the truss system 18 includes pairs of link members 30 (shown as 30A and 30B in FIG. 3) connected to each of the legs 16. Each link member pair 30 has a first end connected to one leg 16 and a second end connected to another leg 16 and has a scissors link that provides for the folding of each link member 30.

Figure 12B:
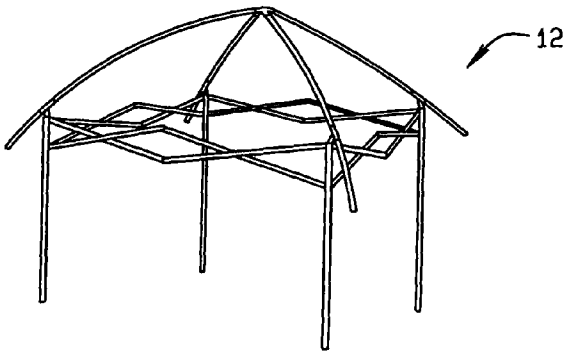
FIGS. 12A and 12B are side perspective views of a canopy support structure having a dome shape according to two exemplary embodiments.
Figure 12A:
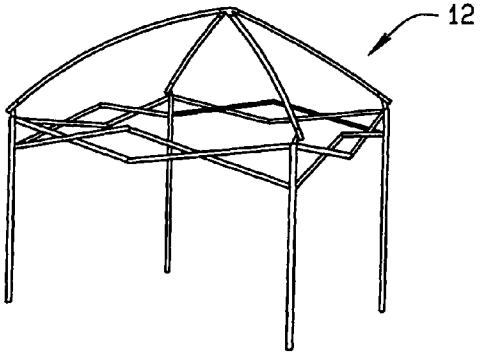

In operation, a shelter 10 with a supporting structure 12 that includes one of the many embodiments of a bracket 22 as described by way of examples in this disclosure, can provide for increased erecting and collapsing a collapsible shelter 10. Additionally, in some embodiments a variety of different canopy designs can be provided by a common support structure 12 and therefore the support for a variety of different shaped canopy covers 14. The adjustable bracket 22 can be changed to provide for different canopy heights and shapes as illustrated by some examples in FIGS. 12, 13, 14, and 15. FIGS. 12A and 12B illustrate one possible supporting structure 12 having a dome shape. FIG. 12A being a dome wherein the canopy footprint is about equal to the footprint defined by the legs. FIG. 12B illustrates the use of a bracket 22 that allows for a predetermined length of rod 20 to extend beyond the bracket 22 for providing a canopy footprint that is greater than the footprint defined by the legs.

Figure 13B:
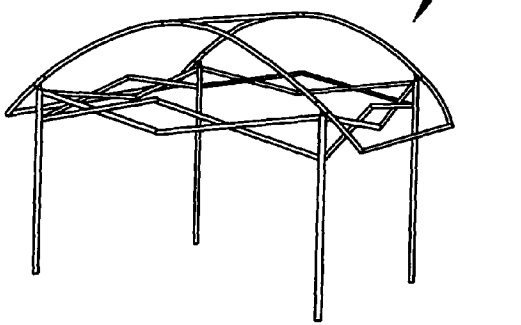
FIGS. 13A and 13B are side perspective views of a canopy support structure having an arch shape according to two exemplary embodiments.
Figure 13A:
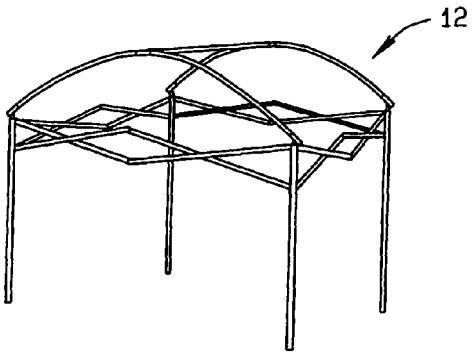
Figure 14A:
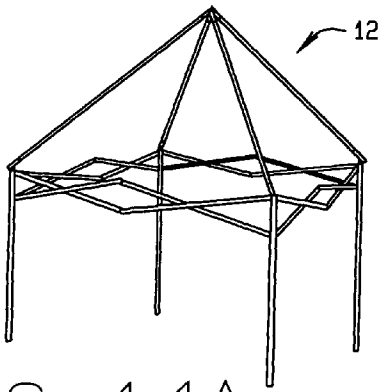
FIGS. 14A and 14B are side perspective views of a canopy support structure having a pyramid shape according to two exemplary embodiments.
Figure 14B:
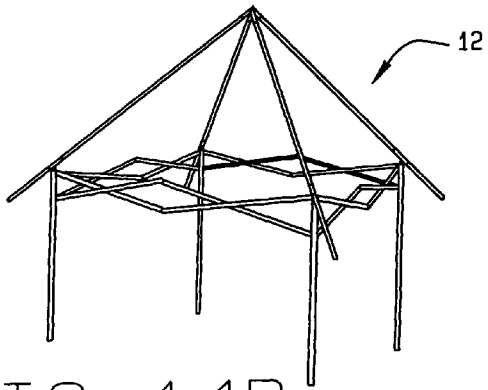
Figure 15A:
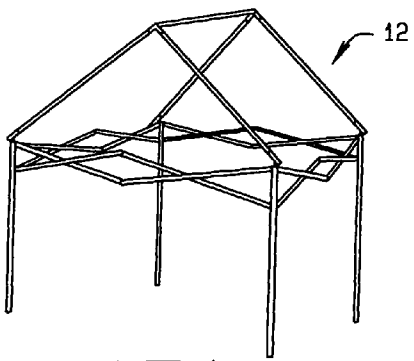
FIGS. 15A and 15B are side perspective views of a canopy support structure having a triangular shape according to two exemplary embodiments.
Figure 15B:
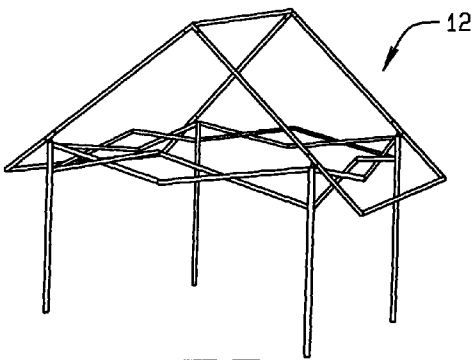

Similar designs for the supporting structure 12 are illustrated in FIGS. 13A and 13B that provides arch shapes, FIGS. 14A and 14B that provides pyramid shapes, and FIGS. 15A and 15B that provides triangular or house roofline shapes. These are just a few of the exemplary embodiments that can be provided by a common leg 16 and truss system 18 assembly for a supporting structure 12, utilizing the flexible bracket 22 as described herein. The canopy supporting structure 12 as described herein can provide flexibility to the manufacturer, the retailer and the user of such a collapsible shelter 10.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in a limiting sense.

It is further to be understood that the processes or steps described herein are not to be construed as necessarily requiring their performance in the particular order discussed or illustrated. It is also to be understood that additional or alternative processes or steps may be employed.

What is claimed is:

1. A collapsible shelter assembly comprising:

a plurality of legs, each of the legs having an upper end, a lower end and defining a vertical axis;

a truss system linking each pair of legs together and defining a perimeter;

a plurality of rods adapted for supporting a cover, each rod having a proximal end and a distal end, and each rod having a plurality of rod segments coupled end to end with each two consecutive rod segments being coupled end to end by a connector;

a plurality of brackets, each bracket having a base adapted for attachment to the upper end of one of the legs and a coupler mounted to the base and having a receptacle with a circular bore for receiving the proximal end of one of the rods, each coupler being rotatable about a horizontal axis that is perpendicular to the vertical leg axis, the coupler having a locking mechanism selectively locking the rotated position of the coupler receptacle about the horizontal axis; and a plurality of hubs, each hub having a different configuration of bores for releasably coupling the distal ends of two more rods together, wherein two or more hub and rod combinations and rotated positions of the coupler in different locked rotated positions form two or more cover support shapes selected from the group consisting of a pyramid, a dome, a triangular roofline, a house roofline, and an arch.

2. The assembly of claim 1 wherein the base is fixed relative to the leg.

3. The assembly of claim 1 wherein the receptacle receives the proximal end of the rod and passes a portion of the rod there through.

4. The assembly of claim 3 wherein the rod includes a stop at a defined length from the proximal end, and wherein the coupler receptacle receives and passes the rod and engages the stop and extends the proximal end of the rod externally from the receptacle to the perimeter defined by the truss system and forming a canopy perimeter that is greater than a perimeter defined by the truss system.

5. The assembly of claim 4 wherein the stop is a clamp selectively positionable along a length of the rod for varying the defined length from the proximal end and extending of the proximal end of the rod externally from the receptacle to the perimeter.

6. The assembly of claim 4 wherein the stop is one of the connectors connecting two consecutive rod segments with one rod segment defining the proximal end of the rod.

7. The assembly of claim 1, further comprising a cover configured to be supported by the rods to form a canopy when the rods are attached to the bracket couplers and the bracket bases are attached to the upper ends of the legs.

8. The assembly of claim 1, further comprising a hub for releasably coupling the distal ends of two more rods together.

9. The assembly of claim 1 wherein each leg defines a cavity at its upper end and wherein the base of each bracket is inserted into the cavity.

10. The assembly of claim 1 wherein the truss system includes pairs of link members connected to each of the legs, the link member pairs having a first end connected to one leg and a second end connected to another leg, and having a scissors link permitting folding of each link member.

11. The assembly of claim 1 wherein the rods are flexible rods and each of the plurality of rod segments is a flexible rod segment.

12. The assembly of claim 1 wherein locking mechanism includes a pair of mated knurled portions, a first of the mated knurled portions being fixedly attached to the coupler with the receptacle and a second of the mated knurled portions being attached to the base, and wherein the pair of mated knurled portions being selectively rotatable about the horizontal axis.

13. The assembly of claim 12 wherein each mated knurled portion includes a knurled circular surface with each having a hole defining the horizontal axis, and wherein the locking mechanism include a fastener positioned within each hole selectively securing the first mated knurled portions together in a selectively fixed rotated position about the horizontal axis.

14. The assembly of claim 1 wherein each rod is attached to one of the legs only by one of the brackets.

15. A collapsible shelter assembly having a plurality of legs, each of the legs having an upper end, a lower end and defining a vertical axis, a truss system linking each pair of legs together and forming a perimeter, and a cover, the shelter comprising:

a plurality of rods for supporting the cover, each rod having a proximal end and a distal end, and each rod having a plurality of rod segments coupled end to end with each two consecutive rod segments being coupled end to end by a connector;

means for pivotally coupling each rod to an upper end of one of the legs about a horizontal axis that is perpendicular to the vertical axis defined by the leg;

means for extending a defined length of the proximal end of each rod beyond each leg and outward from the perimeter defined by the truss system;

means for selectively locking each means for pivotally coupling in a fixed rotated position in a plane including an axis defined by one of the legs; and means for selectively coupling the plurality of rods together in two or more combinations for providing two or more supporting shapes for the cover selected from the group consisting of a pyramid, a dome, a triangular roofline, a house roofline, and an arch.

16. A collapsible shelter assembly having a plurality of legs, each of the legs having an upper end and a lower end and defining a vertical axis, and a truss system linking each pair of legs together and forming a perimeter, the shelter comprising:

a plurality of rods, each rod having a proximal end and a distal end and each includes a plurality of rod segments coupled end to end with each two consecutive rod segments being coupled end to end by a connector;

a plurality of brackets, each bracket having a base adapted for attachment to the upper end one of the legs and a coupler pivotally mounted to the base about a horizontal axis that is perpendicular to the vertical axis as defined by the leg, each bracket having a receptacle with a circular bore for receiving the proximal end of one of the rods there through extending the proximal end outward beyond the leg, each coupler having a locking mechanism selectively locking the rotated position of the coupler receptacle about the horizontal axis, wherein the rods are coupled to the legs only by the pivotally mounted coupler;

at least one hub having a plurality of bores for releasably coupling the distal ends of two or more rods together;

a cover configured to be supported by the hub coupled rods to form a canopy when the rods are attached to the bracket couplers and the bracket bases are attached to the upper ends of the legs; and a plurality of hubs, each hub having a different configuration of bores for releasably coupling the distal ends of two more rods together, wherein two or more hub and rod combinations and rotated positions of the coupler in different locked rotated positions form two or more cover support shapes selected from the group consisting of a pyramid, a dome, a triangular roofline, a house roofline, and an arch.

17. The assembly of claim 16 wherein the rod includes a stop at a defined distance from the proximal end, and the coupler receptacle receives and passes the rod and engages the stop at the defined distance from the end of the rods and extends the proximal end of the rods externally to the perimeter defined by the truss system and forming a canopy perimeter greater than the truss system perimeter.

18. The assembly of claim 17 wherein the stop is a clamp selectively positionable along a length of the rod for varying the defined length from the proximal end and extending of the proximal end of the rod externally from the receptacle to the perimeter.

19. The assembly of claim 17 wherein the stop is one of the connectors connecting two consecutive rod segments with one rod segment defining the proximal end of the rod.

20. The assembly of claim 16 wherein the rods are flexible rods and each of the plurality of rod segments is a flexible rod segment.

21. The assembly of claim 16 wherein the locking mechanism includes a pair of mated knurled portions, a first of the mated knurled portions being fixedly attached to the coupler with the receptacle and a second of the mated knurled portions being attached to the base, and wherein the pair of mated knurled portions being selectively rotatable about the horizontal axis.

22. The assembly of claim 12 wherein each mated knurled portion includes a knurled circular surface having a hole defining the horizontal axis, and wherein the locking mechanism include a fastener positioned with each hole selectively securing the first mated knurled portions together in a selectively fixed rotated position about the horizontal axis.

23. The assembly of claim 16 wherein the base is fixed relative to the leg.

24. The assembly of claim 16 wherein each leg defines a cavity at its upper end and wherein the base of each bracket is inserted into the cavity.

25. A collapsible shelter assembly comprising:

a plurality of legs, each of the legs having an upper end, a lower end and defining a vertical axis;

a truss system linking each pair of legs together and defining a perimeter;

a plurality of rods adapted for supporting a cover, each rod having a proximal end and a distal end, and each rod having a plurality of rod segments coupled end to end with each two consecutive rod segments being coupled end to end by a connector;

a plurality of brackets, each bracket having a base adapted for attachment to the upper end of one of the legs and a coupler mounted to the base and having a receptacle with a circular bore for receiving the proximal end of one of the rods, the receptacle receives the proximal end of the rod and passes a portion of the rod there through, each coupler being rotatable about a horizontal axis that is perpendicular to the vertical leg axis, the coupler having a locking mechanism selectively locking the rotated position of the coupler receptacle about the horizontal axis; wherein the received one of the rods includes a stop at a defined length from the proximal end, the stop being a clamp selectively positionable along a length of the rod for varying the defined length from the proximal end and extending of the proximal end of the rod externally from the receptacle to the perimeter and wherein the coupler receptacle receives and passes the rod and engages the stop and extends the proximal end of the rod externally from the receptacle to the perimeter defined by the truss system and forming a canopy perimeter that is greater than a perimeter defined by the truss system.

26. The assembly of claim 25 wherein the base is fixed relative to the leg.

27. The assembly of claim 25, further comprising a cover configured to be supported by the rods to form a canopy when the rods are attached to the bracket couplers and the bracket bases are attached to the upper ends of the legs.

28. The assembly of claim 25, further comprising a hub for releasably coupling the distal ends of two more rods together.

29. The assembly of claim 25, further comprising a plurality of hubs, each hub having a different configuration of bores for releasably coupling the distal ends of two more rods together, wherein two or more hub and rod combinations and rotated positions of the coupler in different locked rotated positions form two or more cover support shapes selected from the group consisting of a pyramid, a dome, a triangular roofline, a house roofline, and an arch.

30. The assembly of claim 25 wherein each leg defines a cavity at its upper end and wherein the base of each bracket is inserted into the cavity.

31. The assembly of claim 25 wherein the truss system includes pairs of link members connected to each of the legs, the link member pairs having a first end connected to one leg and a second end connected to another leg, and having a scissors link permitting folding of each link member.

32. The assembly of claim 25 wherein the rods are flexible rods and each of the plurality of rod segments is a flexible rod segment.

33. The assembly of claim 25 wherein locking mechanism includes a pair of mated knurled portions, a first of the mated knurled portions being fixedly attached to the coupler with the receptacle and a second of the mated knurled portions being attached to the base, and wherein the pair of mated knurled portions being selectively rotatable about the horizontal axis.

34. The assembly of claim 33 wherein each mated knurled portion includes a knurled circular surface with each having a hole defining the horizontal axis, and wherein the locking mechanism include a fastener positioned within each hole selectively securing the first mated knurled portions together in a selectively fixed rotated position about the horizontal axis.

35. The assembly of claim 25 wherein each rod is attached to one of the legs only by one of the brackets.

36. A collapsible shelter assembly having a plurality of legs, each of the legs having an upper end and a lower end and defining a vertical axis, and a truss system linking each pair of legs together and forming a perimeter, the shelter comprising:

a plurality of rods, each rod having a proximal end and a distal end and each includes a plurality of rod segments coupled end to end with each two consecutive rod segments being coupled end to end by a connector;

a plurality of brackets, each bracket having a base adapted for attachment to the upper end one of the legs and a coupler pivotally mounted to the base about a horizontal axis that is perpendicular to the vertical axis as defined by the leg, each bracket having a receptacle with a circular bore for receiving the proximal end of one of the rods there through extending the proximal end outward beyond the leg, each coupler having a locking mechanism selectively locking the rotated position of the coupler receptacle about the horizontal axis, wherein the rods are coupled to the legs only by the pivotally mounted coupler;

at least one hub having a plurality of bores for releasably coupling the distal ends of two or more rods together;

a cover configured to be supported by the hub coupled rods to form a canopy when the rods are attached to the bracket couplers and the bracket bases are attached to the upper ends of the legs;

wherein the received one of the rods includes a stop at a defined distance from the proximal end, the stop being defined by a clamp selectively positionable along a length of the rod for varying the defined length from the proximal end and extending of the proximal end of the rod externally from the receptacle to the perimeter, and the coupler receptacle receives and passes the rod and engages the stop at the defined distance from the end of the rods and extends the proximal end of the rods externally to the perimeter defined by the truss system and forming a canopy perimeter greater than the truss system perimeter.

37. The assembly of claim 36 wherein the rods are flexible rods and each of the plurality of rod segments is a flexible rod segment.

38. The assembly of claim 36 wherein the locking mechanism includes a pair of mated knurled portions, a first of the mated knurled portions being fixedly attached to the coupler with the receptacle and a second of the mated knurled portions being attached to the base, and wherein the pair of mated knurled portions being selectively rotatable about the horizontal axis.

39. The assembly of claim 38 wherein each mated knurled portion includes a knurled circular surface having a hole defining the horizontal axis, and wherein the locking mechanism include a fastener positioned with each hole selectively securing the first mated knurled portions together in a selectively fixed rotated position about the horizontal axis.

40. The assembly of claim 36 wherein the base is fixed relative to the leg.

41. The assembly of claim 36 wherein each leg defines a cavity at its upper end and wherein the base of each bracket is inserted into the cavity.

* * * * *